US011149993B2

(12) United States Patent
Bao et al.

(10) Patent No.: US 11,149,993 B2
(45) Date of Patent: Oct. 19, 2021

(54) CRYOCOOLER WITH HEAT TRANSFER BLOCKS HAVING FINS

(71) Applicant: SUMITOMO HEAVY INDUSTRIES, LTD., Tokyo (JP)

(72) Inventors: Qian Bao, Tokyo (JP); Mingyao Xu, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 35 days.

(21) Appl. No.: 16/720,934

(22) Filed: Dec. 19, 2019

(65) Prior Publication Data

US 2020/0124325 A1 Apr. 23, 2020

Related U.S. Application Data

(63) Continuation of application No. PCT/JP2018/022244, filed on Jun. 11, 2018.

(30) Foreign Application Priority Data

Jul. 7, 2017 (JP) ..... JP2017-134039
Oct. 24, 2017 (JP) ..... JP2017-205231

(51) Int. Cl.

| | |
|---|---|
| ***F25B 9/00*** | (2006.01) |
| ***F28F 9/24*** | (2006.01) |
| ***F28F 13/08*** | (2006.01) |
| ***F28F 13/06*** | (2006.01) |
| ***F25B 9/14*** | (2006.01) |

(Continued)

(52) U.S. Cl.

CPC ..... *F25B 9/145* (2013.01); *F25B 9/002* (2013.01); *F25B 9/00* (2013.01); *F25B 9/06* (2013.01);

(Continued)

(58) Field of Classification Search

CPC ..... F25B 9/00; F25B 9/06; F25B 9/10; F25B 9/14; F25B 9/145; F28F 9/24;

(Continued)

(56) References Cited

U.S. PATENT DOCUMENTS 5,239,200 A 8/1993 Messina et al.
5,575,155 A * 11/1996 Mita ..... F25B 9/10 62/6

(Continued)

FOREIGN PATENT DOCUMENTS

JP H06-074584 A 3/1994
JP H10-122683 A 5/1998

(Continued)

OTHER PUBLICATIONS

International Search Report issued in Application No. PCT/JP2018/022244, dated Sep. 11, 2018.

*Primary Examiner* — Frantz F Jules
*Assistant Examiner* — Lionel Nouketcha
(74) *Attorney, Agent, or Firm* — Michael Best & Friedrich LLP

(57) ABSTRACT

A cryocooler includes an expansion chamber, a cooling stage thermally coupled to the expansion chamber, the cooling stage including a first heat transfer block provided with a surface exposed to the expansion chamber and a first heat exchange surface disposed outside the expansion chamber and a second heat transfer block provided with a second heat exchange surface facing the first heat exchange surface, a refrigerant supply port installed in the cooling stage outside the expansion chamber, a refrigerant discharge port installed in the cooling stage outside the expansion chamber, and a refrigerant path fluidically separated from the expansion chamber, the refrigerant path being formed between the first heat transfer block and the second heat transfer block such that a refrigerant flows from the refrigerant supply port to the refrigerant discharge port along the first heat exchange surface and the second heat exchange surface.

10 Claims, 11 Drawing Sheets

(51) Int. Cl.
*F25B 9/10* (2006.01)
*F25B 9/06* (2006.01)

(52) U.S. Cl.
CPC . *F25B 9/10* (2013.01); *F25B 9/14* (2013.01); *F25B 2309/1411* (2013.01); *F25B 2309/1416* (2013.01); *F28F 9/24* (2013.01); *F28F 13/06* (2013.01); *F28F 13/08* (2013.01); *F28F 2215/00* (2013.01); *F28F 2215/04* (2013.01)

(58) Field of Classification Search
CPC ..... F28F 13/08; F28F 13/06; F28F 2215/00; F28F 2215/04
See application file for complete search history.

(56) References Cited

U.S. PATENT DOCUMENTS

| | | | | |
|---|---|---|---|---|
| 6,065,295 | A | 5/2000 | Hainer et al. | |
| 6,679,066 | B1 * | 1/2004 | Funayama ..... | F17C 3/08 62/50.2 |
| 9,784,479 | B2 | 10/2017 | Xu et al. | |
| 10,274,230 | B2 | 4/2019 | Bao et al. | |
| 2015/0143820 | A1 | 5/2015 | Kirichek | |

FOREIGN PATENT DOCUMENTS

| | | | |
|---|---|---|---|
| JP | 2000-502175 | A | 2/2000 |
| JP | 2001-248930 | A | 9/2001 |
| JP | 2013-257074 | A | 12/2013 |
| WO | WO-2013/179011 | A1 | 12/2013 |
| WO | WO-2016/068039 | A1 | 5/2016 |

* cited by examiner

CRYOCOOLER WITH HEAT TRANSFER BLOCKS HAVING FINS

RELATED APPLICATIONS

The contents of Japanese Patent Application No. 2017-134039 and Japanese Patent Application No. 2017-205231, and of International Patent Application No. PCT/JP2018/022244, on the basis of each of which priority benefits are claimed in an accompanying application data sheet, are in their entirety incorporated herein by reference.

BACKGROUND

Technical Field

Certain embodiments of the present invention relate to a cryocooler.

Description of Related Art

A cryocooler represented by a Gifford-McMahon (GM) cryocooler includes a cooling stage thermally coupled to a working gas expansion chamber. By appropriately synchronizing a change in volume and a change in pressure of the expansion chamber, a cryocooler can cool the cooling stage to a desired cryogenic temperature. An object to be cooled is thermally coupled to the cooling stage and is cooled by means of the cooling stage. Such a cooling stage is also provided in other cryocoolers such as a sterling cryocooler and a pulse tube cryocooler.

SUMMARY

According to an embodiment of the present invention, there is provided a cryocooler including an expansion chamber, a cooling stage thermally coupled to the expansion chamber, the cooling stage including a first heat transfer block provided with a surface exposed to the expansion chamber and a first heat exchange surface disposed outside the expansion chamber and a second heat transfer block provided with a second heat exchange surface facing the first heat exchange surface, a refrigerant supply port installed in the cooling stage outside the expansion chamber, a refrigerant discharge port installed in the cooling stage outside the expansion chamber, and a refrigerant path fluidically separated from the expansion chamber, the refrigerant path being formed between the first heat transfer block and the second heat transfer block such that a refrigerant flows from the refrigerant supply port to the refrigerant discharge port along the first heat exchange surface and the second heat exchange surface. The first heat exchange surface is provided with a first base surface and at least one first fin extending from the first base surface, the first fin being provided with a first fin tip end. The second heat exchange surface is provided with a second base surface and at least one second fin extending from the second base surface along the first fin, the second fin being provided with a second fin tip end. The first fin tip end is disposed closer to the second base surface than the second fin tip end and the second fin tip end is disposed closer to the first base surface than the first fin tip end. The refrigerant path is provided with a first transverse path formed between the first fin tip end and the second base surface such that the refrigerant crosses over the first fin, a second transverse path formed between the second fin tip end and the first base surface such that the refrigerant crosses over the second fin, and an inter-fin path formed between the first fin and the second fin such that the first transverse path communicates with the second transverse path. The first transverse path is locally formed between the first fin tip end and the second base surface and the second transverse path is locally formed between the second fin tip end and the first base surface. Arrangement of the first transverse path and the second transverse path is determined such that a refrigerant stream in the inter-fin path is guided in a direction that forms an angle with a fin height direction.

DETAILED DESCRIPTION

Figure 1:
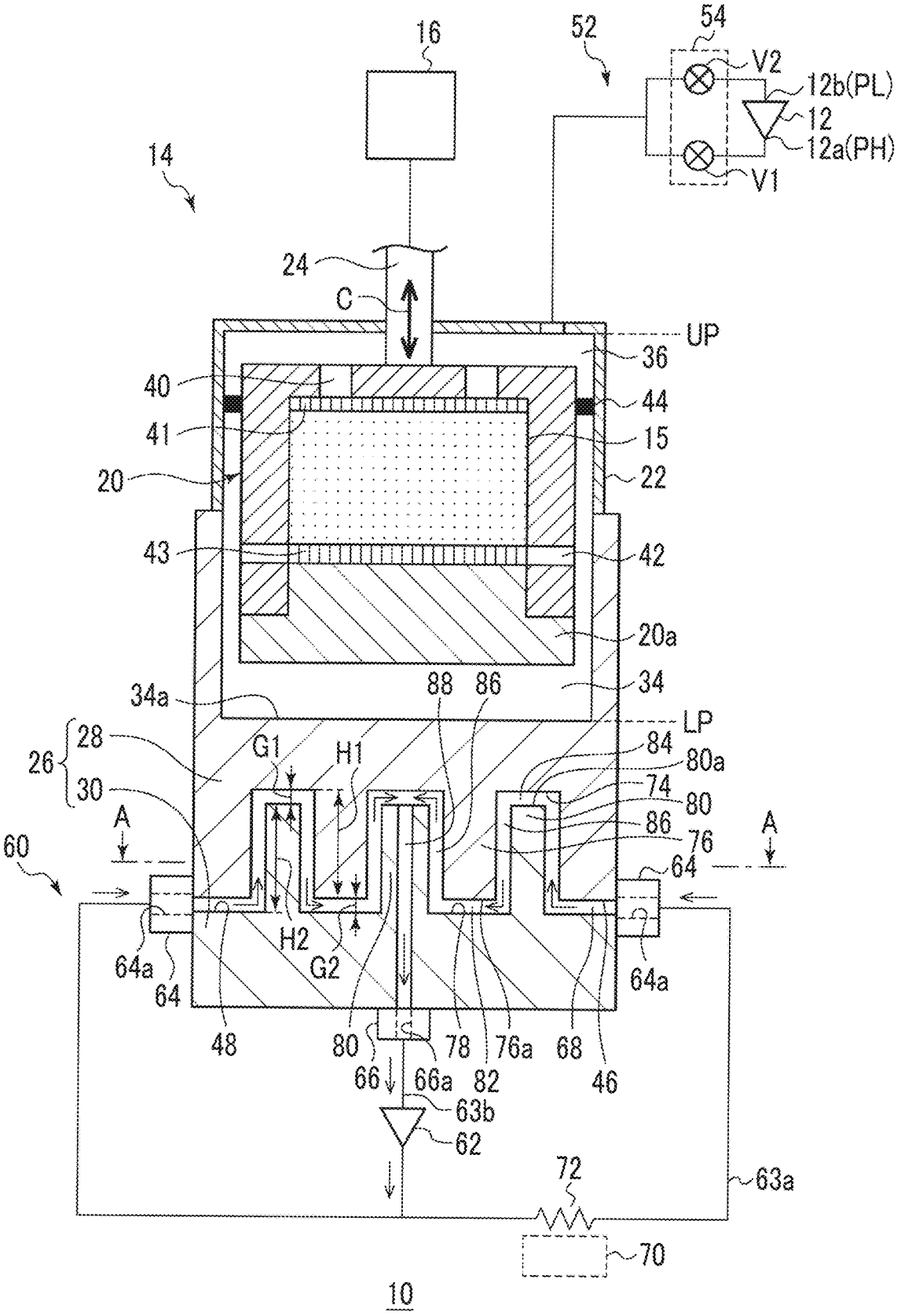
FIG. 1 is a view schematically illustrating a cryocooler according to a first embodiment.

In some cases, a cryocooler is used to cool various refrigerant fluids (hereinafter, also referred to as refrigerant) such as liquid nitrogen, gaseous or liquid helium. The cooled refrigerant is used to cool various devices that require a low temperature environment like a superconducting device and a measuring instrument. In a certain typical configuration, a refrigerant pipe for causing a refrigerant to flow is bonded to an outer surface of a cooling stage of a cryocooler by means of a bonding method such as welding or brazing such that the refrigerant pipe is thermally coupled to the cooling stage. The refrigerant pipe is cooled by means of the cooling stage and the refrigerant is cooled by means of the refrigerant pipe. The bonding state between the refrigerant pipe and the outer surface of the cooling stage influences the refrigerant cooling performance of the cryocooler. A bonding failure of the refrigerant pipe causes large thermal resistance between the refrigerant pipe and the cooling stage, which results in the refrigerant being difficult to be cooled.

It is desirable to provide a technique that improves the cooling performance of a cryocooler.

Note that, any combinations of the above constituent elements, and those obtained by substituting the constituent elements or expressions in the invention with each other between methods, devices, systems, or the like are also effective as an aspect of the present invention.

According to the embodiment of the present invention, it is possible to provide a technique that improves the cooling performance of a cryocooler.

Hereinafter, embodiments of the present invention will be described in detail with reference to drawings. Note that, the same reference numerals are assigned to the same elements and repetitive descriptions thereof will be omitted in the description. In addition, configurations described below are merely an example and do not limit the scope of the present invention. In addition, the size or thickness of each component in the drawing which will be referred to in the following description is for the sake of convenience of the description and actual dimensions or ratios may not be shown.

First Embodiment

Figure 2:
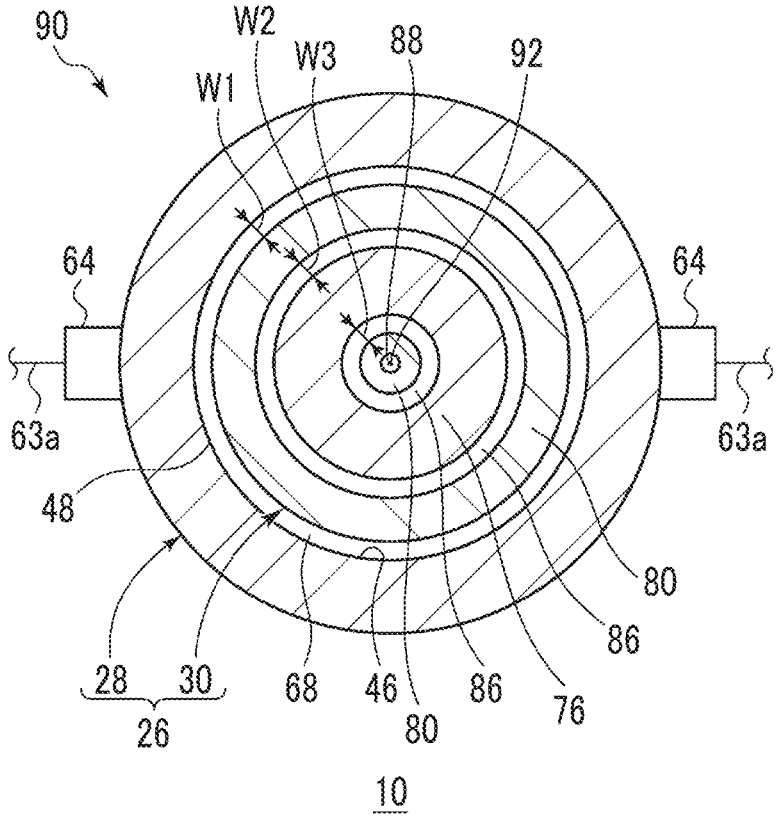
FIG. 2 is a schematic view illustrating a cross-section A-A of the cryocooler in FIG. 1.

FIG. 1 is a view schematically illustrating a cryocooler 10 according to a first embodiment. FIG. 2 is a schematic view illustrating a cross section A-A of the cryocooler 10 in FIG. 1.

The cryocooler 10 is provided with a compressor 12 that compresses a working gas (for example, helium gas) and a cold head 14 that cools the working gas by means of adiabatic expansion. The compressor 12 includes a compressor discharge port 12*a* and a compressor suction port 12*b*. The cold head 14 is also called an expander. The cryocooler 10 shown in the drawing is a single-stage GM cryocooler.

As described later in detail, the compressor 12 supplies a high-pressure (PH) working gas to the cold head 14 via the compressor discharge port 12*a*. The cold head 14 is provided with a regenerator 15 that pre-cools the working gas. The pre-cooled working gas is further cooled by means of expansion in the cold head 14. The working gas is collected to the compressor suction port 12*b* through the regenerator 15. The working gas cools the regenerator 15 when passing through the regenerator 15. The compressor 12 compresses the collected low-pressure (PL) working gas and supplies the working gas to the cold head 14 again. Generally, the high pressure (PH) and the low pressure (PL) are considerably higher than the atmospheric pressure. Typically, the high pressure (PH) is, for example, 2 to 3 MPa and the low pressure (PL) is, for example, 0.5 to 1.5 MPa.

The cold head 14 is provided with a displacer 20 that can reciprocate in an axial direction (vertical direction in FIG. 1 which is represented by arrow C), a cylinder 22 that accommodates the displacer 20, and a displacer drive mechanism 16. The displacer drive mechanism 16 is provided with a connection rod 24 that is coaxially connected to the displacer 20. The cylinder 22 is configured as a part of a pressure vessel for a working gas.

For the displacer drive mechanism 16, various known configurations can be adopted. For example, in the case of a motor-driven GM cryocooler, the displacer drive mechanism 16 is provided with a scotch yoke mechanism and a motor. The displacer 20 is mechanically connected to the motor via the connection rod 24 and the scotch yoke mechanism and is driven by the motor. In the case of a gas-driven GM cryocooler, the displacer 20 is connected to a displacer driving piston via the connection rod 24 and is driven with a gas pressure acting on the displacer driving piston.

The axial reciprocation motion of the displacer 20 is guided by the cylinder 22. Typically, the displacer 20 and the cylinder 22 are cylindrical members extending axially and the outer diameter of the cylinder 22 coincides with or is slightly greater than the outer diameter of the displacer 20. Center axes of the displacer 20 and the cylinder 22 correspond to a center axis 92 of the cryocooler 10 (refer to FIG. 2). The connection rod 24 is smaller than the displacer 20 in diameter.

The cylinder 22 is partitioned into an expansion chamber 34 and a room temperature chamber 36 by the displacer 20. The expansion chamber 34 defines a working gas expansion space of the cryocooler 10. The expansion chamber 34 is formed between an end of the displacer 20 in the axial direction and the cylinder 22 and the room temperature chamber 36 is formed between the other end of the displacer 20 in the axial direction and the cylinder 22. The expansion chamber 34 is disposed on a bottom dead center LP side and the room temperature chamber 36 is disposed on a top dead center UP side. The connection rod 24 passes through the room temperature chamber 36 and extends up to an upper lid portion of the displacer 20.

The cold head 14 is provided with a cooling stage 26 that is fixed to the cylinder 22 to externally cover the expansion chamber 34. The cooling stage 26 is thermally coupled to the expansion chamber 34. The cooling stage 26 is bonded to the cylinder 22 by means of brazing or welding, for example. Details of the cooling stage 26 will be described later.

The regenerator 15 is built into the displacer 20. An upper lid portion of the displacer 20 is provided with inlet flow paths 40 through which the regenerator 15 communicates with the room temperature chamber 36. In addition, a tubular portion of the displacer 20 is provided with outlet flow paths 42 through which the regenerator 15 communicates with the expansion chamber 34. Alternatively, the outlet flow paths 42 may be provided in a lower lid portion of the displacer 20. In addition, the regenerator 15 is provided with an inlet retainer 41 that is in contact with the upper lid portion internally, an outlet retainer 43 that is in contact with the lower lid portion internally, and a regenerator material interposed between both of the retainers. In FIG. 1, the regenerator material is represented by a dotted region interposed between the inlet retainer 41 and the outlet retainer 43. The regenerator material may be a wire mesh formed of copper, for example. The retainer may be a wire mesh coarser than the regenerator material.

A seal portion 44 is provided between the displacer 20 and the cylinder 22. The seal portion 44 is, for example, a slipper seal and is mounted on the tubular portion or the upper lid portion of the displacer 20. Since a clearance between the displacer 20 and the cylinder 22 is sealed by the seal portion 44, no gas flows between the room temperature chamber 36 and the expansion chamber 34 directly (that is, no gas flows bypassing regenerator 15).

When the displacer 20 moves in the axial direction, the volumes of the expansion chamber 34 and the room temperature chamber 36 are increased and decreased complementarily. That is, when the displacer 20 moves downward, the expansion chamber 34 becomes narrower and the room temperature chamber 36 becomes wider. The reverse is also true.

The working gas flows into the regenerator 15 from the room temperature chamber 36 while passing through the inlet flow paths 40. More accurately, the working gas flows into the regenerator 15 from the inlet flow paths 40 while passing through the inlet retainer 41. The working gas flows into the expansion chamber 34 from the regenerator 15 via the outlet retainer 43 and the outlet flow paths 42. When the working gas returns to the room temperature chamber 36 from the expansion chamber 34, the working gas flows reversely. That is, the working gas returns to the room temperature chamber 36 from the expansion chamber 34 while passing through the outlet flow paths 42, the regenerator 15, and the inlet flow paths 40. A working gas flowing through the clearance while bypassing the regenerator 15 is blocked by the seal portion 44.

Furthermore, the cryocooler 10 is provided with a working gas circuit 52 that connects the compressor 12 to the cold head 14. The working gas circuit 52 is provided with a valve unit 54 configured to control the pressure in the expansion chamber 34. The valve unit 54 includes an intake on-off valve V1 and an exhaust on-off valve V2. For the valve unit 54, various known configurations such as a rotary valve type can be adopted.

When the intake on-off valve V1 is open, the exhaust on-off valve V2 is closed. A high-pressure working gas is supplied to the cylinder 22 from the compressor discharge port 12*a* through the intake on-off valve V1. Meanwhile, when the exhaust on-off valve V2 is open, the intake on-off valve V1 is closed. A working gas is collected to the compressor suction port 12*b* from the cylinder 22 through the exhaust on-off valve V2 and the pressure in the cylinder 22 is decreased. Note that, both of the intake on-off valve V1 and the exhaust on-off valve V2 may be closed together temporarily. In this manner, the cylinder 22 is connected to the compressor discharge port 12*a* and the compressor suction port 12*b* alternately.

An exemplary operation of the cryocooler 10 will be described. At the time of a working gas supply step, the displacer 20 is positioned at the bottom dead center LP in the cylinder 22. When the intake on-off valve V1 is opened at the same time as the time as described above or at a timing slightly different from the time as described above, a high-pressure working gas is supplied to the cylinder 22 from the compressor 12. The working gas is supplied to the expansion chamber 34 while being cooled by the regenerator 15.

When the expansion chamber 34 is filled with the high-pressure working gas, the intake on-off valve V1 is closed. At this time, the displacer 20 is positioned at the top dead center UP in the cylinder 22. When the exhaust on-off valve V2 is opened at the same time as the time as described above or at a timing slightly different from the time as described above, the pressure of the working gas in the expansion chamber 34 is decreased and the working gas is expanded. Due to the expansion, the temperature of the working gas becomes low and the working gas absorbs heat from the cooling stage 26.

The displacer 20 moves toward the bottom dead center LP and the volume of the expansion chamber 34 is decreased. The working gas in the expansion chamber 34 cools the regenerator material while passing through the regenerator 15 and is collected to the compressor 12. The cryocooler 10 repeats a cooling cycle with the above-described steps as one cycle to cool the cooling stage 26 to a desired cryogenic temperature.

The cooling stage 26 is provided with a first heat transfer block 28 and a second heat transfer block 30. The cylinder 22, the first heat transfer block 28, and the second heat transfer block 30 are disposed in the axial direction in this order. The cylinder 22 extends in the axial direction from the first heat transfer block 28. The cooling stage 26 is formed to have a cylindrical shape of which the diameter is slightly greater than that of the cylinder 22. The first heat transfer block 28 and the second heat transfer block 30 are formed to form a cylindrical shape when being combined with each other.

The first heat transfer block 28 and the second heat transfer block 30 are formed of metal of which the thermal conductivity is relatively high like copper or other thermal conductive materials. Typically, the first heat transfer block 28 and the second heat transfer block 30 are formed of the same material. However, the first heat transfer block 28 and the second heat transfer block 30 may be formed of different materials. The first heat transfer block 28 is formed from a lump of material by means of, for example, mechanical processing such as cutting. Similarly, the second heat transfer block 30 is also formed from a lump of material by means of, for example, mechanical processing such as cutting.

The first heat transfer block 28 is disposed to surround the expansion chamber 34 and is thermally coupled to the expansion chamber 34. The expansion chamber 34 is formed between the first heat transfer block 28 and a displacer bottom portion 20*a*. The first heat transfer block 28 includes a surface exposed to the expansion chamber 34 and the exposed surface includes an expansion chamber bottom surface 34*a* facing the displacer bottom portion 20*a*. The expansion chamber bottom surface 34*a* forms a flat surface approximately perpendicular to the center axis 92 of the cryocooler 10. The first heat transfer block 28 is provided with a first heat exchange surface 46 disposed outside the expansion chamber 34. The first heat exchange surface 46 faces a side opposite to the expansion chamber bottom surface 34*a* in the axial direction.

In addition, the second heat transfer block 30 is disposed to be adjacent to the first heat transfer block 28 and is thermally coupled to the expansion chamber 34 via the first heat transfer block 28. The second heat transfer block 30 is bonded to the first heat transfer block 28 by means of, for example, brazing or welding. An outer peripheral portion of the second heat transfer block 30 is bonded to an outer peripheral portion of the first heat transfer block 28. The second heat transfer block 30 is disposed outside the expansion chamber 34 and is not provided with a surface exposed to the expansion chamber 34. The second heat transfer block 30 is provided with a second heat exchange surface 48 facing the first heat exchange surface 46.

The cryocooler 10 is provided with a refrigerant circuit 60 in which a refrigerant flows. The refrigerant circuit 60 is fluidically separated from the working gas circuit 52. The refrigerant circuit 60 is provided as a system different from the working gas circuit 52 and both of the refrigerant circuit 60 and the working gas circuit 52 are separated from each other. A refrigerant flowing in the refrigerant circuit 60 is not mixed with a working gas flowing in the working gas circuit 52. The type of the refrigerant may be the same as that of the working gas (for example, refrigerant may be helium gas). The type of the refrigerant may be different from that of the working gas (for example, refrigerant may be liquid nitrogen). In any cases, typically, the pressure of the refrigerant in the refrigerant circuit 60 is lower than the pressure of the working gas in the working gas circuit 52 and is approximately equal to the atmospheric pressure.

The refrigerant circuit 60 is provided with a refrigerant pump 62, refrigerant supply ports 64, a refrigerant discharge port 66, and a refrigerant path 68.

The refrigerant pump 62 is provided for circulating a refrigerant in the refrigerant circuit 60. The refrigerant pump 62 is connected to the refrigerant supply ports 64 and the refrigerant discharge port 66 such that a refrigerant discharged from the refrigerant discharge port 66 is sent to the refrigerant supply ports 64. A discharge port of the refrigerant pump 62 is connected to the refrigerant supply ports 64 via a refrigerant supply pipe 63*a* and a collection port of the refrigerant pump 62 is connected to the refrigerant discharge port 66 via a refrigerant discharge pipe 63*b*. The refrigerant pump 62, the refrigerant supply pipe 63*a*, and the refrigerant discharge pipe 63*b* may not be regarded as a portion of the cryocooler 10. The refrigerant supply pipe 63*a* and the refrigerant discharge pipe 63*b* may be prepared by a user of the cryocooler 10 after being manufactured by a manufacturer different from a manufacturer of the cryocooler 10.

The refrigerant supply ports 64 and the refrigerant discharge port 66 are installed at an outer surface of the cooling stage 26, as a part of the cryocooler 10. Therefore, the refrigerant supply ports 64 and the refrigerant discharge port 66 are disposed outside the expansion chamber 34. The refrigerant supply ports 64 are provided refrigerant inlet holes 64*a* through which a refrigerant flows into the cooling stage 26 (specifically, into refrigerant path 68). The refrigerant inlet holes 64*a* connect the refrigerant supply pipe 63*a* to the refrigerant path 68. The refrigerant discharge port 66 is provided with a refrigerant outlet hole 66*a* through which a refrigerant flows out from the inside of the cooling stage 26 (specifically, from refrigerant path 68). The refrigerant outlet hole 66*a* connects the refrigerant path 68 to the refrigerant discharge pipe 63*b*. A refrigerant is supplied to the refrigerant path 68 from the refrigerant pump 62 through the refrigerant supply ports 64. In addition, a refrigerant is discharged to the refrigerant pump 62 from the refrigerant path 68 through the refrigerant discharge port 66.

Although the positions and the number of the refrigerant supply ports 64 at the outer surface of the cooling stage 26 are not particularly limited, in the present embodiment, a plurality of refrigerant supply ports 64 are disposed at an outer peripheral surface of the cooling stage 26 at equal intervals in a circumferential direction. The refrigerant supply ports 64 are provided in a boundary between the first heat transfer block 28 and the second heat transfer block 30. However, the present invention is not limited thereto. The number of the refrigerant supply ports 64 may be one. One refrigerant discharge port 66 is disposed at a central portion of an end surface of the second heat transfer block 30 that is opposite to the second heat exchange surface 48. However, the present invention is not limited thereto. A plurality of the refrigerant discharge ports 66 may be provided.

The refrigerant path 68 is fluidically separated from the expansion chamber 34. The refrigerant path 68 is formed inside the cooling stage 26 and penetrates the cooling stage 26. In the cooling stage 26, the refrigerant path 68 and the expansion chamber 34 are separated from each other. No working gas flows into the refrigerant path 68 from the expansion chamber 34. No refrigerant leaks into the expansion chamber 34 from the refrigerant path 68.

The refrigerant path 68 is formed between the first heat transfer block 28 and the second heat transfer block 30 such that a refrigerant flows from the refrigerant supply ports 64 to the refrigerant discharge port 66 along the first heat exchange surface 46 and the second heat exchange surface 48. The refrigerant path 68 is formed between the first heat exchange surface 46 and the second heat exchange surface 48.

A heat exchanger 72 for cooling an object 70 is provided between the refrigerant pump 62 and the refrigerant supply ports 64. The heat exchanger 72 is connected to an intermediate portion of the refrigerant supply pipe 63*a*. The heat exchanger 72 may be connected to an intermediate portion of the refrigerant discharge pipe 63*b* between the refrigerant discharge port 66 and the refrigerant pump 62. The object 70 is thermally connected to the heat exchanger 72. With a cooled refrigerant being caused to flow into the heat exchanger 72, the object 70 is cooled.

The interval between the first heat exchange surface 46 of the first heat transfer block 28 and the second heat exchange surface 48 of the second heat transfer block 30 is constant. The flow path width of the refrigerant path 68 is constant throughout the refrigerant path 68. However, the above-described point is not essential and as described below, the interval between the first heat exchange surface 46 and the second heat exchange surface 48 may be different by place.

The first heat exchange surface 46 is provided with a first base surface 74 and at least one first fin 76 extending from the first base surface 74. The first base surface 74 forms a flat surface approximately parallel to the expansion chamber bottom surface 34*a* and faces a side opposite to the expansion chamber bottom surface 34*a* in the axial direction. It can be said that the first base surface 74 is an upper surface of the refrigerant path 68. The first fin 76 is provided with a first fin tip end 76*a*. The first heat transfer block 28 is provided with one first fin 76. However, the first heat transfer block 28 may be provided with a plurality of the first fins 76. An outer peripheral portion of the first heat transfer block 28 can be regarded as another first fin 76.

The second heat exchange surface 48 is provided with a second base surface 78 and at least one second fin 80 extending from the second base surface 78. The second base surface 78 forms a flat surface approximately parallel to the first base surface 74. It can be said that the second base surface 78 is a lower surface of the refrigerant path 68. The second fins 80 extend along the first fin 76. Each second fin 80 is provided with a second fin tip end 80*a*. The second heat transfer block 30 is provided with two second fins 80. However, the number of the second fins 80 may be one and the number of the second fins 80 may be three or more.

The second base surface 78 forms a recessed portion between the two adjacent second fins 80, which accommodates the first fin 76. In addition, in a case where the first heat transfer block 28 is provided with a plurality of the first fins 76, the first base surface 74 forms a recessed portion between two adjacent first fins 76, which accommodates the second fin 80.

The first fin tip end 76*a* is disposed closer to the second base surface 78 than the second fin tip ends 80*a*. The second fin tip ends 80*a* are disposed closer to the first base surface 74 than the first fin tip end 76*a*. In this manner, the first fin 76 is inserted between the two adjacent second fins 80 such that the first fin 76 and the second fins 80 are disposed alternately. Accordingly, the meandering refrigerant path 68 is formed.

The first fin 76 and the second fins 80 extend in the axial direction. Therefore, the first fin 76 and the second fins 80 have fin heights in the axial direction. A height (distance from first base surface 74 to first fin tip end 76*a*) H1 of the first fin 76 is larger than an interval G1 from the first base surface 74 and the second fin tip ends 80*a*. A height (distance from second base surface 78 to second fin tip ends 80*a*) H2 of the second fins 80 is larger than an interval G2 from the second base surface 78 and the first fin tip end 76*a*. The height H1 of the first fin 76 and the height H2 of the second fins 80 are equal to each other. As necessary, the height H1 and the height H2 may be made different from each other. The interval G1 between the first base surface 74 and the second fin tip ends 80*a* and the interval G2 between the second base surface 78 and the first fin tip end 76*a* are equal to each other. The interval G1 and the interval G2 may be different from each other.

The refrigerant path 68 is provided with a first transverse path 82, second transverse paths 84, and inter-fin paths 86. The first transverse path 82 is formed between the first fin tip end 76*a* and the second base surface 78 such that a refrigerant crosses over the first fin 76. The second transverse paths 84 are formed between the second fin tip ends 80*a* and the first base surface 74 such that a refrigerant crosses over the second fins 80. The inter-fin paths 86 are formed between the first fin 76 and the second fins 80. Through the inter-fin paths 86, the first transverse path 82 and the second transverse paths 84 communicate with each other.

A plurality of the inter-fin paths 86 are formed. One inter-fin path 86 is formed between one of the two adjacent second fins 80 and the first fin 76 and another inter-fin path 86 is formed between the other of the two adjacent second fins 80 and the first fin 76. Two inter-fin paths 86 communicate with each other via the first transverse path 82. As shown in FIG. 2, widths W1, W2, and W3 of the inter-fin paths 86 are equal to each other. Note that, the widths W1, W2, and W3 may be equal to the above-descried intervals G1 and G2.

As shown in FIG. 1, when a refrigerant flows through the first transverse path 82, the refrigerant crosses over the first fin 76 along the first fin tip end 76*a*. When a refrigerant flows through the second transverse path 84, the refrigerant crosses over the second fin 80 along the second fin tip end 80*a*. The inter-fin path 86 guides a refrigerant from the first transverse path 82 to the second transverse path 84 or from the second transverse path 84 to the first transverse path 82.

As shown in FIG. 2, the second heat transfer block 30 is fixed to the first heat transfer block 28 such that the second fins 80 and the first fin 76 are combined with each other and a concentric ring-shaped structure 90 that is disposed to be coaxial with the center axis 92 of the cryocooler 10 is formed. In many cases, the cryocooler 10 has an approximately axially symmetric structure. Therefore, the concentric ring-shaped structure 90 is easy to apply to the cryocooler 10 in comparison with other structures.

The first fin 76 has a ring-like shape centered on the center axis 92 of the cryocooler 10. Each of the second fins 80 also has a ring-like shape centered on the center axis 92 of the cryocooler 10. However, the diameters of the second fins 80 are different from that of the first fin 76. The first fin 76 and the second fins 80 extend in the circumferential direction around the center axis 92 of the cryocooler 10.

The first fin 76 and the second fins 80 have fin thicknesses in a radial direction of the cryocooler 10 and have fin lengths in the circumferential direction. In the case of ring-like shapes, the fin lengths correspond to the circumferences of the rings. The fin heights and the fin lengths are greater than the fin thicknesses. In addition, the fin lengths are greater than the fin heights. Conversely, the fin lengths may be smaller than the fin heights.

The concentric ring-shaped structure 90 is provided inside the cooling stage 26 such that a fin height direction, a fin thickness direction, and a fin length direction respectively coincide with the axial direction, the radial direction, and the circumferential direction of the cryocooler 10. However, the concentric ring-shaped structure 90 may not be disposed as described above. The concentric ring-shaped structure 90 may be disposed at any position in the cooling stage 26 and in any direction. In this case, the fin height direction, the fin thickness direction, and the fin length direction may not respectively coincide with the axial direction, the radial direction, and the circumferential direction of the cryocooler 10.

The first fin 76 and the second fins 80 are continuous throughout the entire circumferences thereof. Therefore, the first transverse path 82, the second transverse paths 84, and the inter-fin paths 86 are also continuous throughout the entire circumferences thereof. That is, the first fin tip end 76*a* is separated from the second base surface 78 throughout the entire circumferences thereof. The second fin tip ends 80*a* are separated from the first base surface 74 throughout the entire circumferences thereof. In addition, the first fin 76 and the second fins 80 are separated from each other throughout the entire circumferences thereof.

However, the first transverse path 82 may be divided into a plurality of sections with the first fin tip end 76*a* being in contact with the second base surface 78 partially. Each second transverse path 84 may be divided into a plurality of sections with the second fin tip ends 80*a* being in contact with the first base surface 74 partially. Similarly, each inter-fin path 86 may be divided into a plurality of sections with the first fin 76 being in contact with the second fins 80 partially. The first transverse path 82, the second transverse paths 84, and the inter-fin paths 86 may be divided in, for example, the circumferential direction in this manner.

The first fin 76 and the second fins 80 may be divided in the circumferential direction. A gap between segments of the divided first fin 76 (or second fin 80) may be a portion of the refrigerant path 68. One second fin 80 is formed on the center axis 92 of the cryocooler 10 and this second fin 80 has a rod-like shape. Note that, a configuration in which the first fin 76 is formed on the center axis 92 of the cryocooler 10 and has a rod-like shape may also be adopted.

In addition, the refrigerant path 68 is provided with an outlet path 88 through which the refrigerant discharge port 66 communicates with the refrigerant path 68. The outlet path 88 penetrates the second heat transfer block 30 along the center axis 92 of the cryocooler 10. Since the second fin 80 is formed on the center axis 92 of the cryocooler 10, the outlet path 88 penetrates the second fin 80 in a height direction thereof and connects the second transverse path 84 to the refrigerant outlet hole 66*a*. Note that, in a case where the first fin 76 is formed on the center axis 92 of the cryocooler 10, the outlet path 88 may penetrate the second heat transfer block 30 from the second base surface 78 facing the first fin 76 disposed on the center axis 92 and may be connected to the refrigerant discharge port 66.

The refrigerant supply ports 64 are installed in the cooling stage 26 such that a refrigerant is supplied to an outer peripheral portion of the concentric ring-shaped structure 90. The refrigerant path 68 is configured such that a refrigerant is guided to the central portion of the concentric ring-shaped structure 90 from the outer peripheral portion of the concentric ring-shaped structure 90. The refrigerant discharge port 66 is installed in the cooling stage 26 such that a refrigerant is discharged from the central portion of the concentric ring-shaped structure 90.

As described above, the refrigerant path 68 is configured such that a refrigerant radially flows from an outer peripheral portion of the cooling stage 26 to the central portion of the cooling stage 26. The refrigerant flows into the outer peripheral portion of the concentric ring-shaped structure 90 through the refrigerant supply ports 64 and vertically and horizontally flows to the second transverse path 84, the inter-fin path 86, the first transverse path 82, the inter-fin path 86, the second transverse path 84, and the outlet path 88. As a result, the refrigerant is discharged to the refrigerant discharge port 66 from the central portion of the concentric ring-shaped structure 90. For the sake of understanding, a direction in which the refrigerant flows is represented by arrows in FIG. 1.

The refrigerant path 68 serves as a heat exchanger for cooling a refrigerant by means of the cooling stage 26, which is integrated with the cooling stage 26. A refrigerant stream in the refrigerant path 68 comes into contact with the first heat exchange surface 46 and is cooled due to heat exchange with the first heat exchange surface 46. In addition, the refrigerant stream in the refrigerant path 68 comes into contact with the second heat exchange surface 48 and is cooled due to heat exchange with the second heat exchange surface 48.

The object 70 can be cooled by causing a refrigerant cooled in this manner to flow to the heat exchanger 72. A refrigerant heated due to heat exchange with the object 70 is re-cooled by means of the cooling stage 26 when flowing through the refrigerant path 68. The re-cooled refrigerant is used for cooling of the object 70 again.

According to the cryocooler 10 in the first embodiment, the heat exchanger that cools a refrigerant is integrated into the cooling stage 26. More specifically, the refrigerant path 68 is formed between the first heat exchange surface 46 and the second heat exchange surface 48 such that a refrigerant flows from the refrigerant supply ports 64 to the refrigerant discharge port 66 along the first heat exchange surface 46 and the second heat exchange surface 48. Since the heat exchanger is integrated in this manner, it is more reliably secure thermal contact between the cryocooler 10 and a refrigerant in comparison with an external attachment type heat exchange configuration in the related art in which a refrigerant pipe is bonded to an outer surface of a cooling stage. Therefore, with the cryocooler 10, it is possible to cool a refrigerant more efficiently.

In the cryocooler 10, the meandering refrigerant path 68 is formed by a combination of the first fin 76 and the second fins 80. It is possible to increase the area of contact between a refrigerant and the heat exchange surfaces in comparison with a case where such fins are not provided and both of the two heat exchange surface facing each other are flat surfaces. Therefore, the heat exchange efficiency of the cryocooler 10 is improved.

In addition, in a case where the cryocooler 10 has an approximately axially symmetric structure, the temperature of the central portion of the cooling stage 26 becomes slightly lower than the temperature of the outer peripheral portion of the cooling stage 26. The refrigerant supply ports 64 are disposed at the outer peripheral portion of the cooling stage 26 and the refrigerant discharge port 66 is disposed at the central portion of the cooling stage 26. The temperature of a refrigerant in each of the refrigerant supply ports 64 is relatively high since the refrigerant is heated by the object 70. Since the refrigerant supply ports 64 are disposed at portions of the cooling stage 26 of which the temperature is relatively high, a difference in temperature between a refrigerant and the cooling stage 26 at the refrigerant supply ports 64 can be reduced. A small difference in temperature results in an improvement in heat exchange efficiency. The above-described points also contributes to an improvement in heat exchange efficiency of the cryocooler 10.

Figure 3:
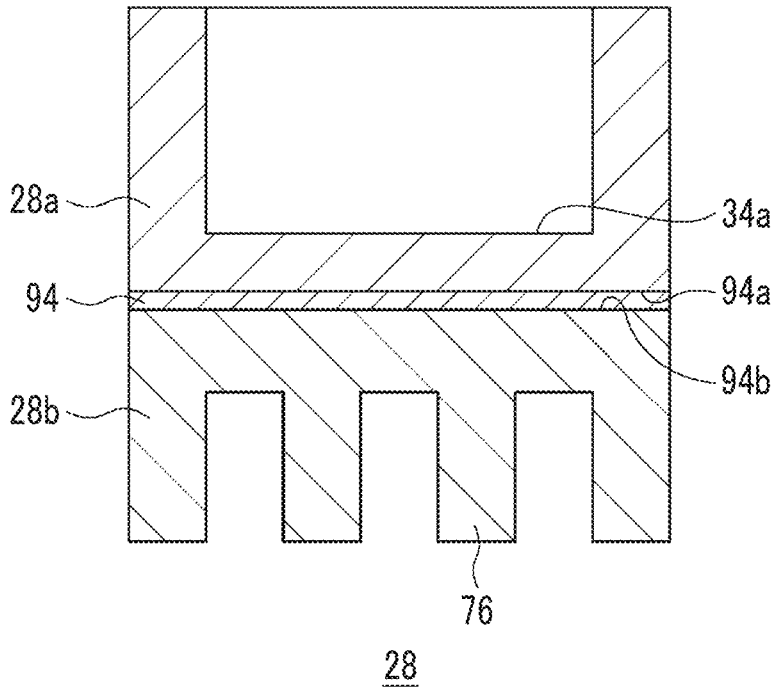
FIG. 3 is a schematic view illustrating another example of a first heat transfer block according to the first embodiment.

FIG. 3 is a schematic view illustrating another example of the first heat transfer block 28 according to the first embodiment. In the above-described embodiment, the first heat transfer block 28 is formed of a lump of material. However, the present invention is not limited thereto. The first heat transfer block 28 may be formed by a plurality of sub-blocks. The first heat transfer block 28 may be formed by the plurality of sub-blocks bonded to each other by means of brazing or welding. The second heat transfer block 30 may also be formed by a plurality of sub-blocks.

As shown in FIG. 3, the first heat transfer block 28 is provided with an expansion chamber forming sub-block 28*a* and a first fin sub-block 28*b*. The expansion chamber forming sub-block 28*a* is provided with the expansion chamber bottom surface 34*a* and the first fin sub-block 28*b* is provided with the first fin 76. The first fin sub-block 28*b* is bonded to the expansion chamber forming sub-block 28*a* via a bonding layer 94 such as a brazing layer. The expansion chamber forming sub-block 28*a* is provided with a flat bonding surface 94*a*, the first fin sub-block 28*b* is provided with a flat bonding surface 94*b*, and the two bonding surfaces 94*a* and 94*b* are bonded to each other via the bonding layer 94. The bonding surfaces 94*a* and 94*b* may be flat surfaces parallel to the expansion chamber bottom surface 34*a*. Bonding such flat surfaces firmly is easier than bonding a typical external attachment type heat exchanger in the related art to an outer surface of a cooling stage.

Note that, it is preferable that the first heat transfer block 28 and the second heat transfer block 30 are also bonded to each other by means of flat bonding surfaces. Therefore, a configuration in which the outer peripheral portion of the first heat transfer block 28 is an annular flat surface, the outer peripheral portion of the second heat transfer block 30 is an annular flat surface, and the two annular flat surfaces are bonded to each other by means of brazing or welding may also be adopted.

Figure 4:
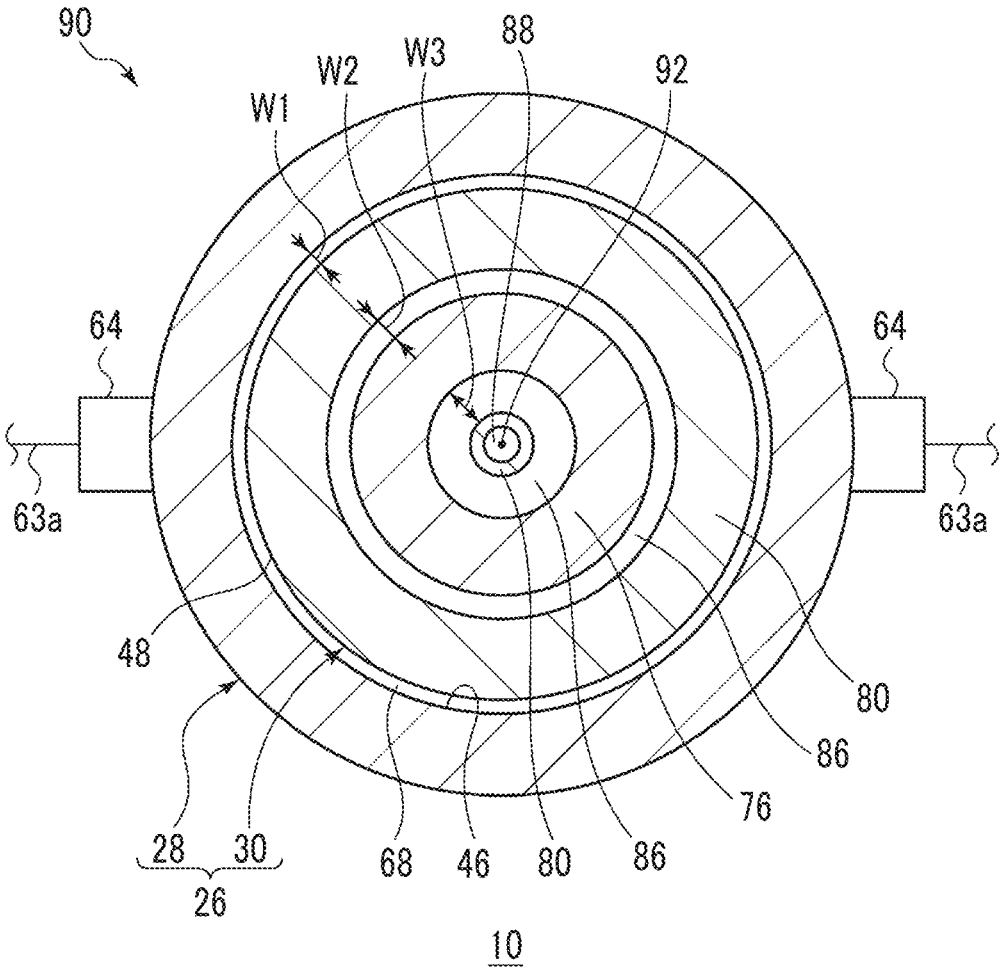
FIG. 4 is a schematic view illustrating another example of a cooling stage according to the first embodiment.

FIG. 4 is a schematic view illustrating another example of the cooling stage 26 according to the first embodiment. As shown in the drawing, the interval between the first heat exchange surface 46 and the second heat exchange surface 48 at the outer peripheral portion of the concentric ring-shaped structure 90 may be smaller than the interval between the first heat exchange surface 46 and the second heat exchange surface 48 at the central portion of the concentric ring-shaped structure 90.

In a case where the interval between the first heat exchange surface 46 and the second heat exchange surface 48 is uniform as in the embodiment shown in FIG. 2, the flow path sectional areas (areas of sections cut along plane perpendicular to center axis 92) of the inter-fin paths 86 become greater toward the outer peripheral portion of the concentric ring-shaped structure 90. This is because the diameter of the inter-fin path 86 positioned on an outer side in the concentric ring-shaped structure 90 is larger than the diameter of the inter-fin path 86 positioned on an inner side in the concentric ring-shaped structure 90. The larger a flow path sectional area is, the smaller a flow path resistance is. That is, in the case of the concentric ring-shaped structure 90 shown in FIG. 2, a flow path resistance at the outer peripheral portion is relatively small and a flow path resistance at the central portion is relatively great. The more uniform a flow path resistance is, the higher the efficiency of heat exchange in the concentric ring-shaped structure 90 is.

In addition, as one of evaluation indexes for the heat exchanger, the ratio of a heat exchange amount to a pressure drop (=heat exchange amount/pressure drop) is considered. The value of the above-described evaluation index being large means that the performance of the heat exchanger is good. In the vicinity of the refrigerant supply ports 64, a difference in temperature between a refrigerant and the cooling stage 26 is large and thus a heat exchange amount is large. Therefore, in the case of the vicinity of the refrigerant supply ports 64, the above-described evaluation index is somewhat large even when a flow path is narrow and a pressure drop is large. However, in the case of the vicinity of the refrigerant discharge port 66, since a refrigerant is cooled already, a difference in temperature between the refrigerant and the cooling stage 26 is small and thus a heat exchange amount is also small. Therefore, in a case where there is a large pressure drop in the vicinity of the refrigerant discharge port 66, the above-described evaluation index becomes considerably small, which is not desirable.

Therefore, as shown in FIG. 4, the width of the refrigerant path 68 made relatively small at the outer peripheral portion of the concentric ring-shaped structure 90 and the width of the refrigerant path 68 made relatively large at the central portion of the concentric ring-shaped structure 90. The width W1 of the inter-fin path 86 on the outer side is smaller than the width W2 of the inter-fin path 86 at an intermediate position. In addition, the width W2 of the inter-fin path 86 at the intermediate position is smaller than the width W3 of the inter-fin path 86 on the inner side. As a result, it is possible to make both of the flow path resistance of the refrigerant path 68 and the above-described evaluation index more uniform.

In the first embodiment, as described above, the first transverse path 82 and the second transverse paths 84 are formed throughout the entire circumference of the concentric ring-shaped structure 90 and a refrigerant stream in the inter-fin paths 86 is guided in the fin height direction. However, the present invention is not limited thereto. Examples thereof will be described below.

Second Embodiment

Figure 5:
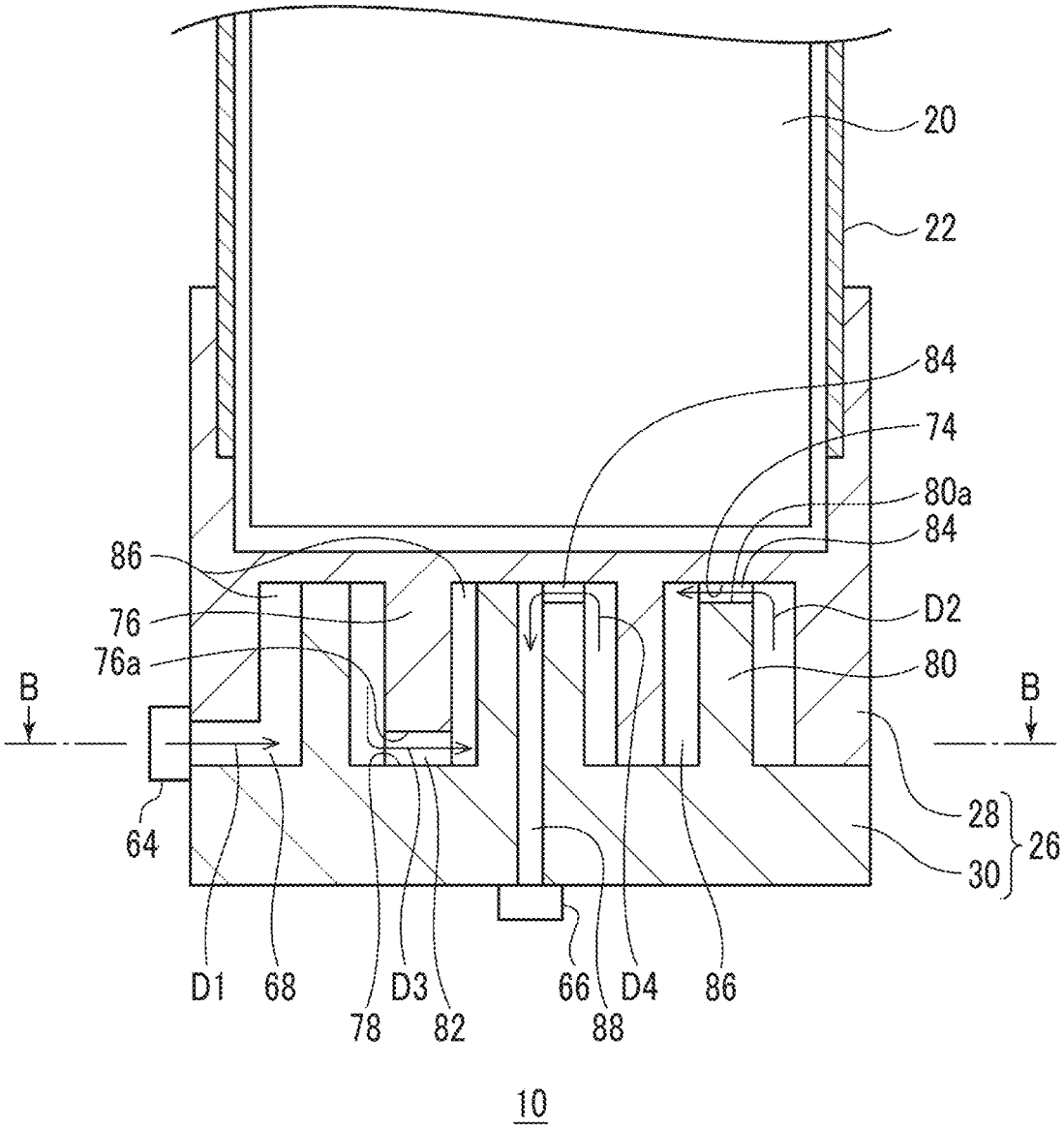
FIG. 5 is a view schematically illustrating a main part of a cryocooler according to a second embodiment.
Figure 6:
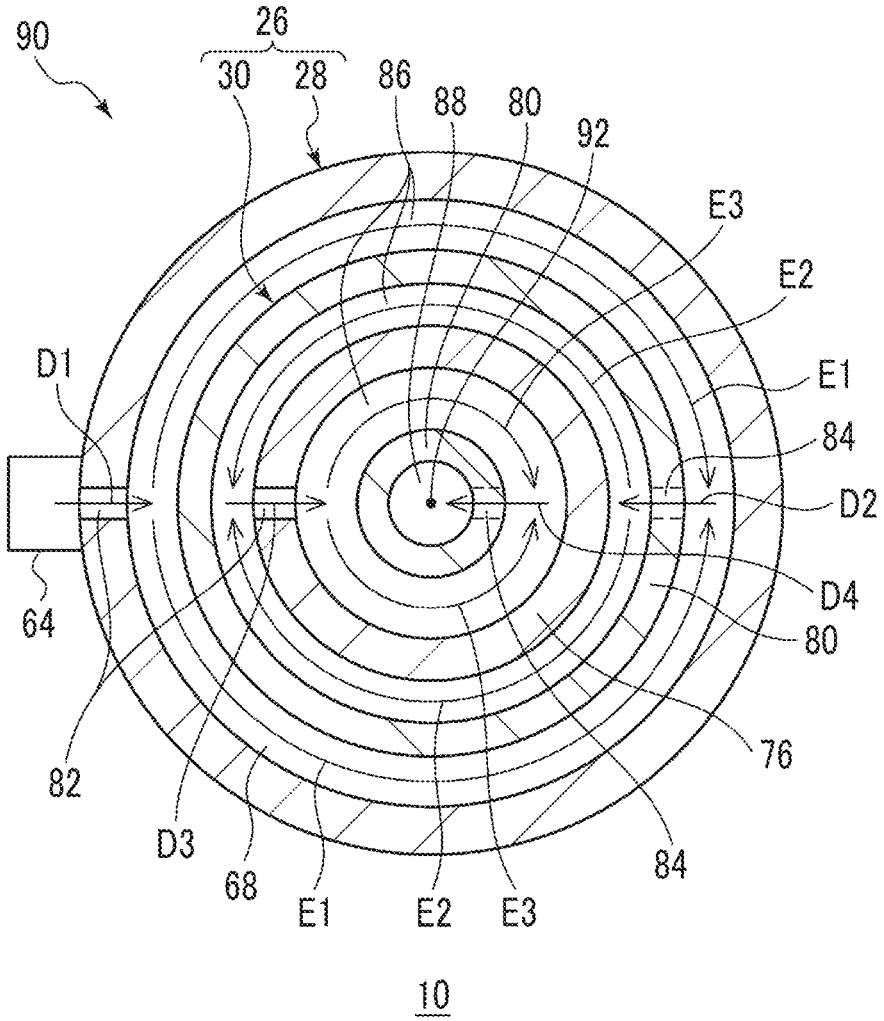
FIG. 6 is a schematic view illustrating a cross-section B-B of the cryocooler in FIG. 5.

FIG. 5 is a view schematically illustrating a main part of the cryocooler 10 according to a second embodiment. FIG. 6 is a schematic view illustrating a cross section B-B of the cryocooler 10 in FIG. 5. FIG. 5 shows the cooling stage 26 and a structure in the vicinity of the cooling stage 26 and FIG. 6 shows the concentric ring-shaped structure 90. The refrigerant path 68 of the cryocooler 10 according to the second embodiment is different from that in the first embodiment.

The first transverse paths 82 are locally formed between the first fin tip ends 76*a* and the second base surface 78 and the second transverse paths 84 are locally formed between the second fin tip ends 80*a* and the first base surface 74. One first transverse path 82 is formed for one first fin 76 and one second transverse path 84 is formed for one second fin 80.

A greater portion of each first fin tip end 76*a* is in contact with the second base surface 78, a specific portion of each first fin tip end 76*a* in the circumferential direction is provided with one depression, and each depression forms the first transverse path 82. A greater portion of each second fin tip end 80*a* is in contact with the first base surface 74, a specific portion of each second fin tip end 80*a* in the circumferential direction is provided with one depression, and each depression forms the second transverse path 84.

The arrangement of the first transverse paths 82 and the second transverse paths 84 is determined such that refrigerant streams in the inter-fin paths 86 are guided in a direction that forms an angle with the fin height direction. The first transverse paths 82 and the second transverse paths 84 are disposed at different positions in the circumferential direction. More specifically, the first transverse paths 82 and the second transverse paths 84 are disposed on opposite sides with respect to the center axis 92. Accordingly, refrigerant streams in the inter-fin paths 86 are guided in a direction inclined with respect to the fin height direction (that is, axial direction) or the circumferential direction.

Only one refrigerant supply port 64 is provided.

For the sake of understanding, directions in which a refrigerant flows are represented by arrows in FIG. 5 and FIG. 6 and the corresponding arrows are given the same reference numerals D1 to D4 in FIG. 5 and FIG. 6. A refrigerant from the refrigerant supply port 64 passes through the first transverse path 82 on the outer side and flows into the inter-fin path 86 on the outer side (arrow D1). The refrigerant branches into two streams and the two streams join each other after each of the two streams flows half around the inter-fin path 86 on the outer side (arrows E1). Thereafter, the refrigerant flows into the inter-fin path 86 at an intermediate position from the second transverse path 84 on the outer side (arrow D2). The refrigerant branches into two streams again and the two streams join each other after each of the two streams flows half around the inter-fin path 86 at the intermediate position (arrows E2). Thereafter, the refrigerant flows into the inter-fin path 86 on the inner side from the first transverse path 82 on the inner side (arrow D3). The refrigerant branches into two streams again and the two streams join each other after each of the two streams flows half around the inter-fin path 86 on the inner side (arrows E3). Thereafter, the refrigerant passes through the outlet path 88 from the second transverse path 84 on the inner side and is discharged via the refrigerant discharge port 66 (arrow D4).

According to the second embodiment, refrigerant streams in the inter-fin paths 86 are guided in a direction that forms an angle with the fin height direction. The refrigerant streams in the inter-fin path 86 are directed in an approximately circumferential direction. The refrigerant path 68 is lengthened in comparison with a case where refrigerant streams in the inter-fin path 86 are guided in the fin height direction as in the first embodiment. In this manner, it is possible to increase the area of contact between a refrigerant and the heat exchange surfaces and thus the heat exchange efficiency of the cryocooler 10 is improved.

Note that the first transverse paths 82 and the second transverse paths 84 are disposed at different positions in the fin height direction. The first transverse paths 82 are positioned on a lower side and the second transverse paths 84 are positioned on an upper side. Therefore, the length of a flow path from the first transverse path 82 to the second transverse path 84 is long in comparison with a case where the first transverse path 82 and the second transverse path 84 are disposed at the same height as each other. The above-described point also contributes to an increase in area of contact between a refrigerant and the heat exchange surfaces.

In addition, a fact that the number of the refrigerant supply ports 64 is one and the number of the refrigerant discharge port 66 is one also contributes to an increase in length of the refrigerant path 68.

Note that, the positions and the number of the first transverse paths 82 and the positions and the number of the second transverse paths 84 are not particularly limited. For example, one first fin 76 may be provided with a plurality of the first transverse paths 82. The plurality of first transverse paths 82 may be disposed at equal angular intervals in the circumferential direction. Similarly, one second fin 80 may be provided with a plurality of the second transverse paths 84. The plurality of second transverse paths 84 may be disposed at equal angular intervals in the circumferential direction.

Third Embodiment

Figure 7:
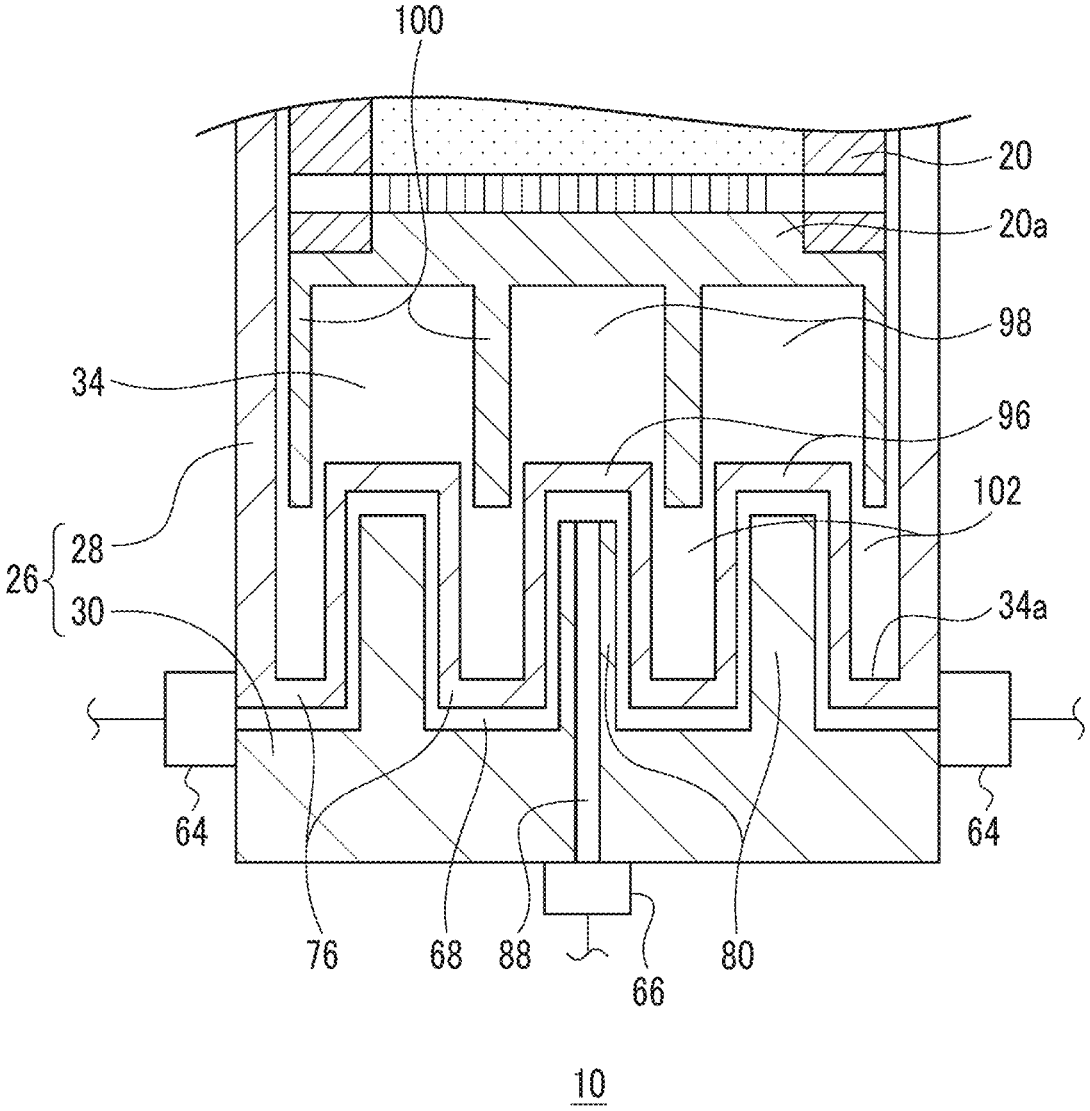
FIG. 7 is a view schematically illustrating a main part of a cryocooler according to a third embodiment.

FIG. 7 is a view schematically illustrating a main part of the cryocooler 10 according to a third embodiment.

The expansion chamber bottom surface 34*a* is provided with a ring-shaped protrusion 96 disposed to be coaxial with the displacer 20. In addition, the displacer bottom portion 20*a* is provided with a ring-shaped recessed portion 98 that accommodates the ring-shaped protrusion 96. Not only the refrigerant path 68 but also the expansion chamber 34 may be provided with a fin-type heat exchanger in this manner. Since the area of heat exchange between a working gas and the cooling stage 26 in the cryocooler 10 is increased, the heat exchange efficiency of the cryocooler 10 is improved.

In addition, the ring-shaped protrusion 96 is made hollow such that the ring-shaped protrusion 96 accommodates the second fins 80 from a side opposite to the expansion chamber bottom surface 34*a*. In this case, it is possible to improve the thermal coupling of the expansion chamber 34 and the refrigerant path 68. In addition, since the second fins 80 can be accommodated in the ring-shaped protrusion 96, the axial length of the cooling stage 26 can be reduced.

In other words, the displacer 20 is provided with a displacer bottom portion fin 100 that extends toward the expansion chamber bottom surface 34*a*. In the first heat transfer block 28, a cavity portion 102 that is formed above the expansion chamber bottom surface 34*a* to accommodate the displacer bottom portion fin 100 and with which the first fin 76 is made hollow is formed. In this case, it is possible to improve the thermal coupling of the expansion chamber 34 and the refrigerant path 68. In addition, since the displacer bottom portion fin 100 can be accommodated into the cavity portion 102 of the first fin 76, the axial length of the cooling stage 26 can be reduced.

Fourth Embodiment

Figure 8:
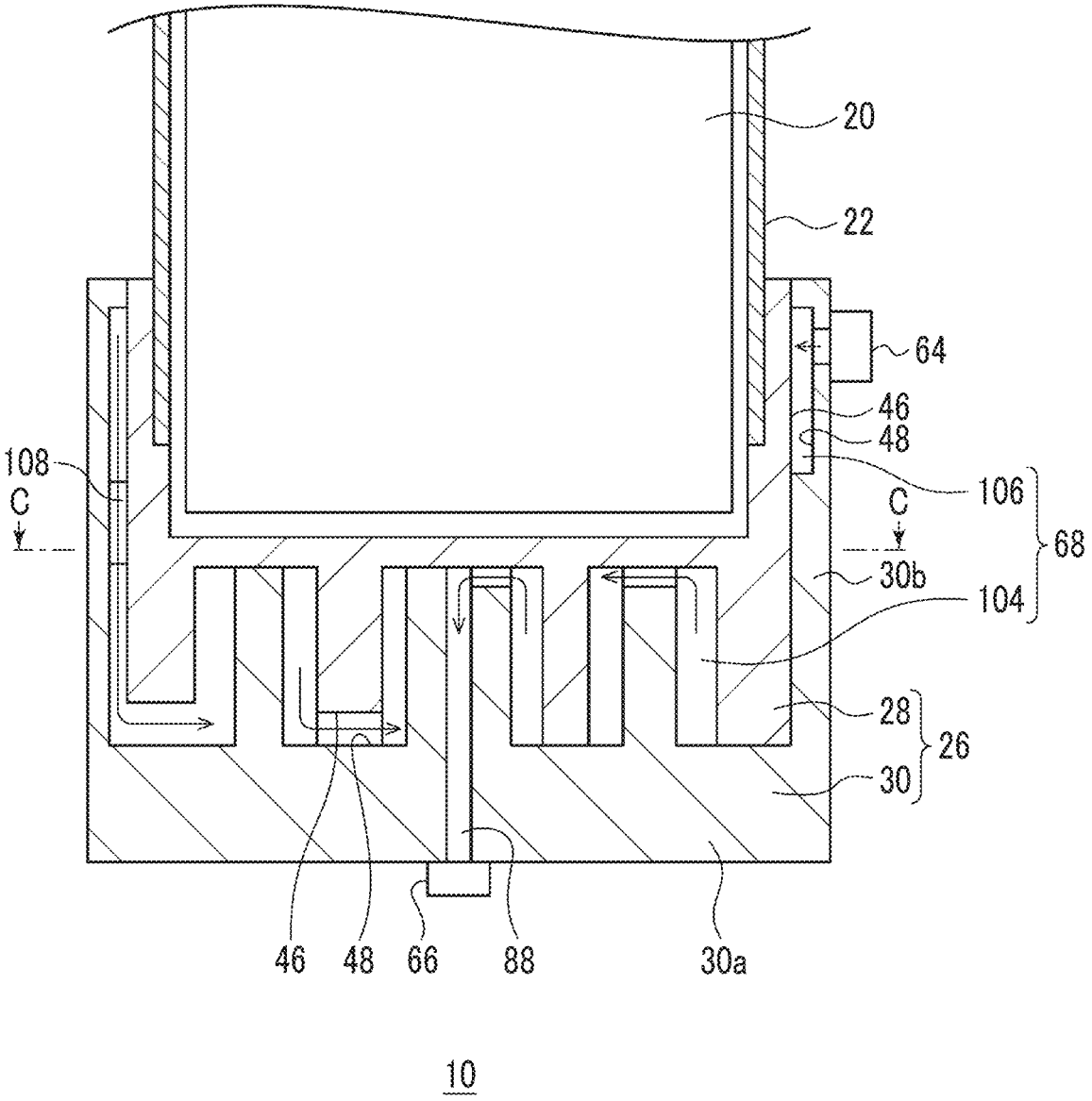
FIG. 8 is a view schematically illustrating a main part of a cryocooler according to a fourth embodiment.
Figure 9:
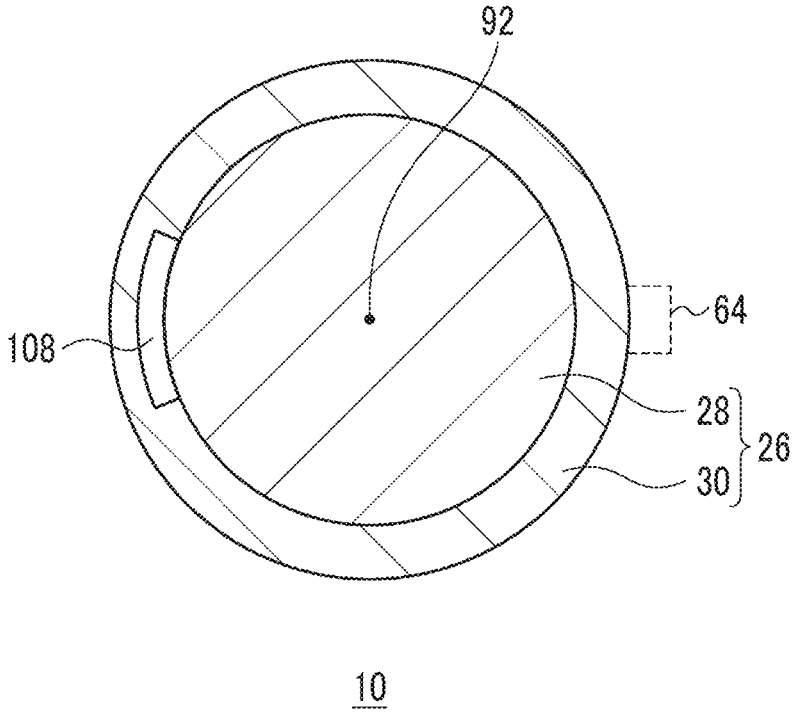
FIG. 9 is a schematic view illustrating a cross-section C-C of the cryocooler in FIG. 8.

FIG. 8 is a view schematically illustrating a main part of the cryocooler 10 according to a fourth embodiment. FIG. 9 is a schematic view illustrating a cross section C-C of the cryocooler 10 in FIG. 8. In the above-described embodiments, the refrigerant path 68 includes a single layer but the present invention is not limited thereto.

The refrigerant path 68 is divided into a plurality of layers. The plurality of layers are disposed at different positions in the axial direction. The plurality of layers are connected to each other such that a refrigerant flows therethrough sequentially. Each layer can be called a sub-path since each layer constitutes a part of the refrigerant path 68.

As shown in FIG. 8, the refrigerant path 68 is divided into a first layer 104 and a second layer 106. In the cooling stage 26, the first layer 104 is disposed at a lower portion in the axial direction and the second layer 106 is disposed at an upper portion in the axial direction. As described above, the first layer 104 and the second layer 106 are adjacent to each other in the axial direction.

The second heat transfer block 30 of the cooling stage 26 is disposed to surround the first heat transfer block 28. The second heat transfer block 30 is provided with a second heat transfer block bottom portion 30*a* and a second heat transfer block side tubular portion 30*b*. The second heat transfer block bottom portion 30*a* is adjacent to the first heat transfer block 28 in the axial direction and the second heat transfer block side tubular portion 30*b* extends axially upward from the second heat transfer block bottom portion 30*a* and surrounds the entire circumference of the first heat transfer block 28.

The refrigerant supply port 64 is installed in the second heat transfer block side tubular portion 30*b* such that a refrigerant is supplied to the second layer 106 of the refrigerant path 68. The second layer 106 is formed between the first heat exchange surface 46 and the second heat exchange surface 48. More specifically, the second layer 106 is a circumferential flow path that is formed between an outer peripheral surface of the first heat transfer block 28 and an inner peripheral surface of the second heat transfer block side tubular portion 30*b*. The first layer 104 of the refrigerant path 68 is formed between the first heat transfer block 28 and the second heat transfer block bottom portion 30*a*. For example, the first layer 104 is a meandering flow path formed by fins facing each other as in the above-described second embodiment. The first layer 104 may be a meandering flow path similar to that in the first embodiment or the third embodiment. The refrigerant discharge port 66 is installed at the second heat transfer block bottom portion 30*a* such that a refrigerant is discharged from the first layer 104.

In addition, the refrigerant path 68 includes a communication path 108 that connects the first layer 104 and the second layer 106 to each other. The communication path 108 is formed between the outer peripheral surface of the first heat transfer block 28 and the inner peripheral surface of the second heat transfer block side tubular portion 30*b* and extends in the axial direction from the first layer 104 to the second layer 106. As shown in FIG. 9, the communication path 108 is provided on aside opposite to the refrigerant supply port 64 with respect to the center axis 92. For the sake of understanding, the refrigerant supply port 64 is represented by a broken line in FIG. 9. For example, the sectional shape of the communication path 108 is a thin and long rectangular shape curved along the circumference. However, the present invention is not limited thereto. The sectional shape of the communication path 108 may be a circular shape, an oval shape, or other any shapes.

In this manner, the refrigerant path 68 is formed between the first heat transfer block 28 and the second heat transfer block 30 such that a refrigerant flows from the refrigerant supply ports 64 to the refrigerant discharge port 66 along the first heat exchange surface 46 and the second heat exchange surface 48. A refrigerant flows into the second layer 106 via the refrigerant supply port 64, the refrigerant branches into two streams, the two streams join each other after each of the two streams flows half around the second layer 106, and the refrigerant flows into the communication path 108. The refrigerant flows into the first layer 104 from the communication path 108, passes through the outlet path 88, and is discharged via the refrigerant discharge port 66.

According to the fourth embodiment, the refrigerant path 68 is divided into the plurality of layers in the axial direction. The plurality of layers are connected to each other such that a refrigerant flows therethrough sequentially. As a result, according to the fourth embodiment, the refrigerant path 68 can be widened upward in the axial direction unlike the first to third embodiments where the refrigerant path 68 is accommodated in a bottom portion of the cooling stage 26. Therefore, according to the fourth embodiment, it is possible to increase the flow path length of the refrigerant path 68 and to promote heat exchange between a refrigerant and the heat exchange surfaces. Therefore, the heat exchange efficiency of the cryocooler 10 is improved.

In the above-described example, the refrigerant path 68 includes two layers. However, the present invention is not limited thereto. The refrigerant path 68 may be divided into three or more layers.

Figure 10A:
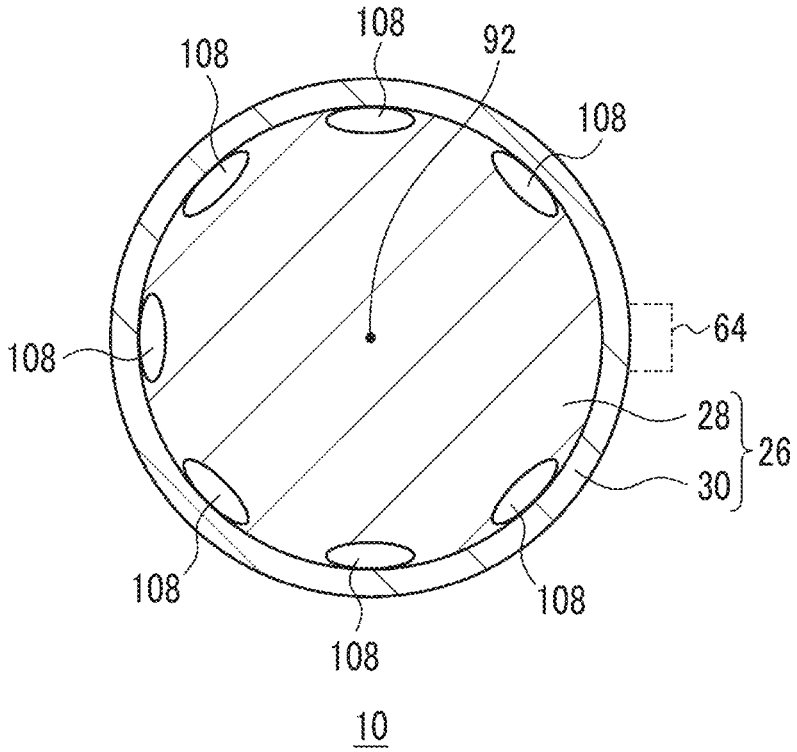
FIGS. 10A and 10B are schematic views illustrating other examples of a communication path in the cryocooler according to the fourth embodiment.
Figure 10B:
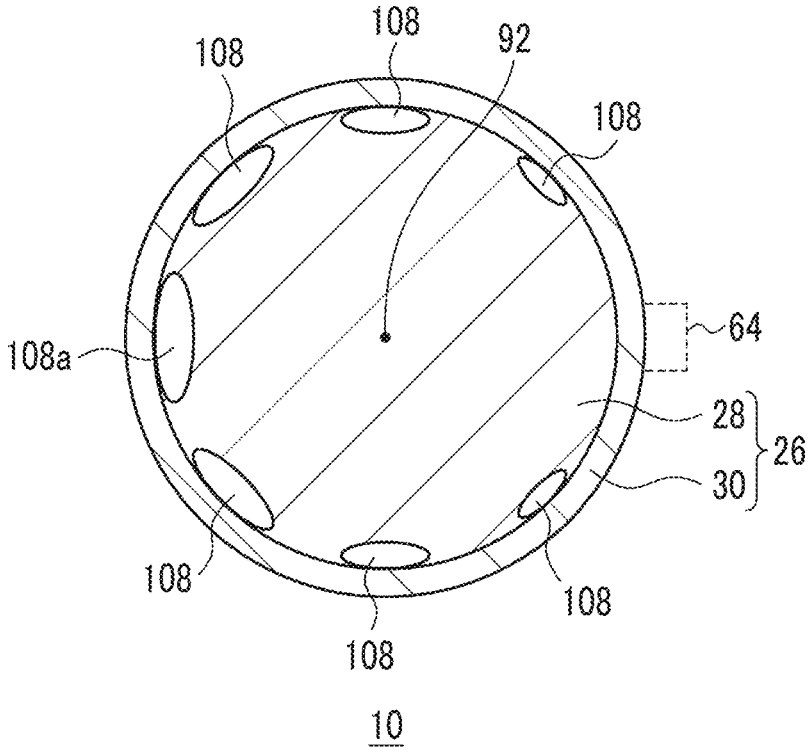

FIGS. 10A and 10B are schematic views illustrating other examples of the communication path 108 in the cryocooler 10 according to the fourth embodiment. FIGS. 10A and 10B illustrate sections perpendicular to the center axis 92. In the embodiment described with reference to FIGS. 8 and 9, one communication path 108 is provided. However, the present invention is not limited thereto.

As shown in FIG. 10A, a plurality of the communication paths 108 may also be provided. The plurality of communication paths 108 are formed between the first heat transfer block 28 and the second heat transfer block 30. The communication paths 108 may be grooves formed in the outer peripheral surface of the first heat transfer block 28 and may be grooves formed in the inner peripheral surface of the second heat transfer block 30. The communication paths 108 may be through-holes formed in any of the first heat transfer block 28 and the second heat transfer block 30.

The plurality of communication paths 108 are disposed at equal angular intervals along the circumference around the center axis 92 except for the vicinity of the refrigerant supply port 64. For example, seven communication paths 108 are disposed at 45-degree intervals and one of the communication paths 108 is provided on a side opposite to the refrigerant supply port 64 with respect to the center axis 92. The flow path sectional areas (area of section perpendicular to axial direction) of the plurality of communication paths 108 are equal to each other. The sectional shape of each communication path 108 is, for example, an oval shape. However, the present invention is not limited thereto.

In addition, as shown in FIG. 10B, the flowpath sectional areas of the plurality of communication paths 108 may be different from each other. The flow path sectional areas of the communication paths 108 may become smaller toward the refrigerant supply port 64 and greater away from the refrigerant supply port 64. Therefore, a communication path 108*a* that is provided on a side opposite to the refrigerant supply port 64 with respect to the center axis 92 is largest in flow path sectional area. In a case as shown in FIG. 10A, the flow rate of a refrigerant passing through the communication path 108 distant from (for example, on side opposite to) the refrigerant supply port 64 is smaller than the flow rate of a refrigerant passing through the communication path 108 close to the refrigerant supply port 64 and as a result, heat exchange in the communication path 108 distant from the refrigerant supply port 64 may be insufficient. According to the configuration shown in FIG. 10B, it is possible to make the flow rates of refrigerants passing through the plurality of communication paths 108 uniform and to effectively use the area of heat exchange in the communication path 108 distant from the refrigerant supply port 64 in comparison with a case as shown in FIG. 10A.

Figure 11:
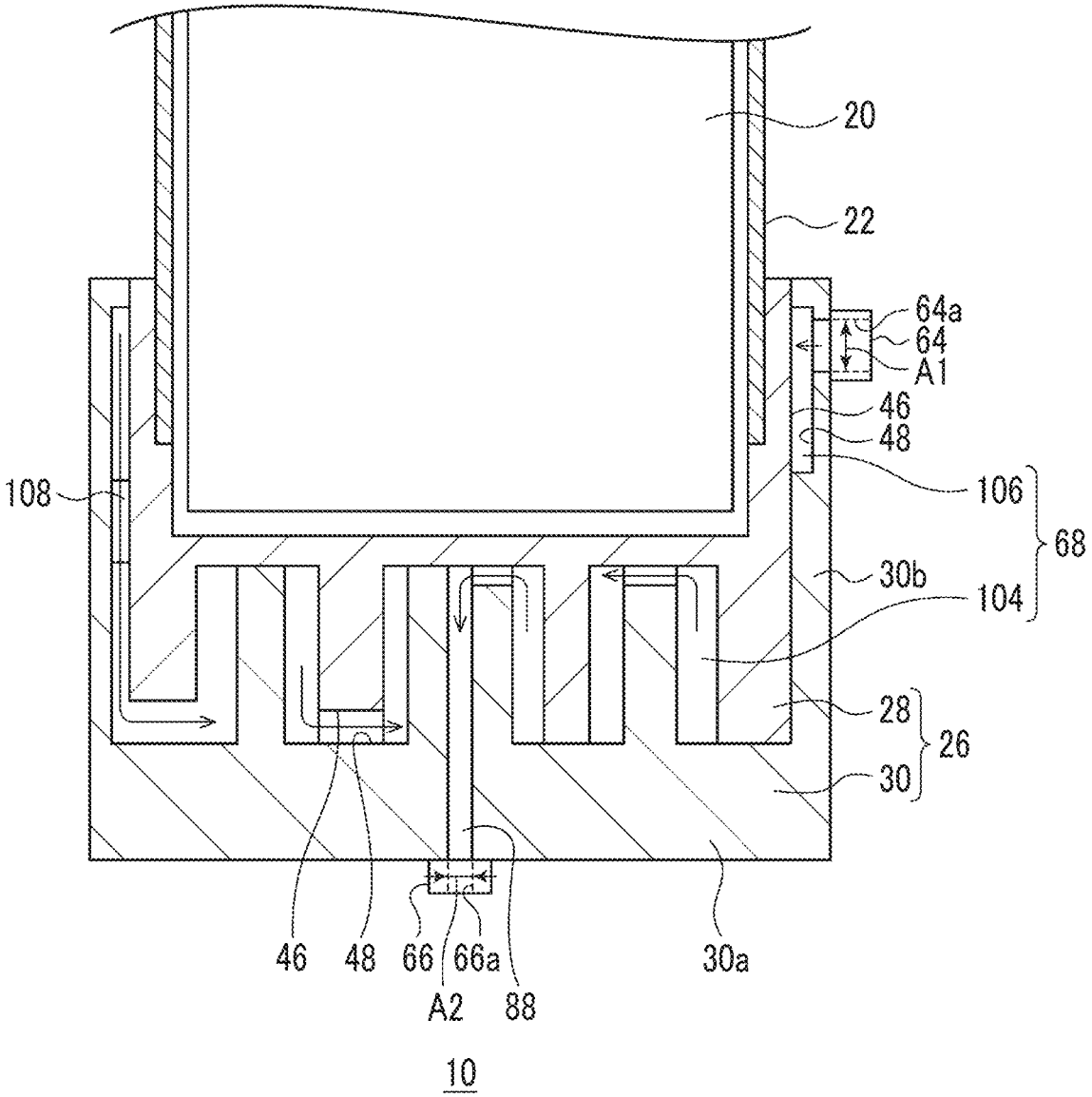
FIG. 11 is a view schematically illustrating another example of the cryocooler according to the fourth embodiment.

FIG. 11 is a view schematically illustrating another example of the cryocooler 10 according to the fourth embodiment. In the embodiment described with reference to FIGS. 8 and 9, the flow path sectional areas of the refrigerant supply port 64 and the refrigerant discharge port 66 are equal to each other. However, the present invention is not limited thereto.

A flow path sectional area A1 of the refrigerant inlet hole 64*a* of the refrigerant supply port 64 may be larger than a flow path sectional area A2 of the refrigerant outlet hole 66*a* of the refrigerant discharge port 66. In a case where both of the refrigerant inlet hole 64*a* and the refrigerant outlet hole 66*a* are circular, the diameter of the refrigerant inlet hole 64*a* may be larger than the diameter of the refrigerant outlet hole 66*a*. The flow direction of a refrigerant flowing into the refrigerant path 68 via the refrigerant supply port 64 is considerably changed when the refrigerant enters the second layer 106 via the refrigerant inlet hole 64*a*. That is, a refrigerant radially flowing into the refrigerant path 68 via the refrigerant inlet hole 64*a* curves in a circumferential direction at the second layer 106. Such a sudden change in flow direction causes an increase in flow path resistance. However, since a refrigerant flowing from the refrigerant path 68 to the refrigerant discharge port 66 flows linearly in the axial direction, the flow path resistance is relatively small.

Accordingly, it is possible to make a flow path resistance at the refrigerant supply port 64 equal to than a flow path resistance at the refrigerant discharge port 66 or small by making the flow path sectional area A1 of the refrigerant supply port 64 greater than the flow path sectional area A2 of the refrigerant discharge port 66. It is possible to prevent a flow path resistance at the refrigerant supply port 64 from being excessive. The above-described point contributes to an improvement in efficiency of heat exchange between the cooling stage 26 and a refrigerant.

Note that, even in a case where the refrigerant path 68 does not include a plurality of layers as in the first to third embodiments, the flow path sectional area A1 of the refrigerant supply port 64 may be greater than the flow path sectional area A2 of the refrigerant discharge port 66.

Figure 12:
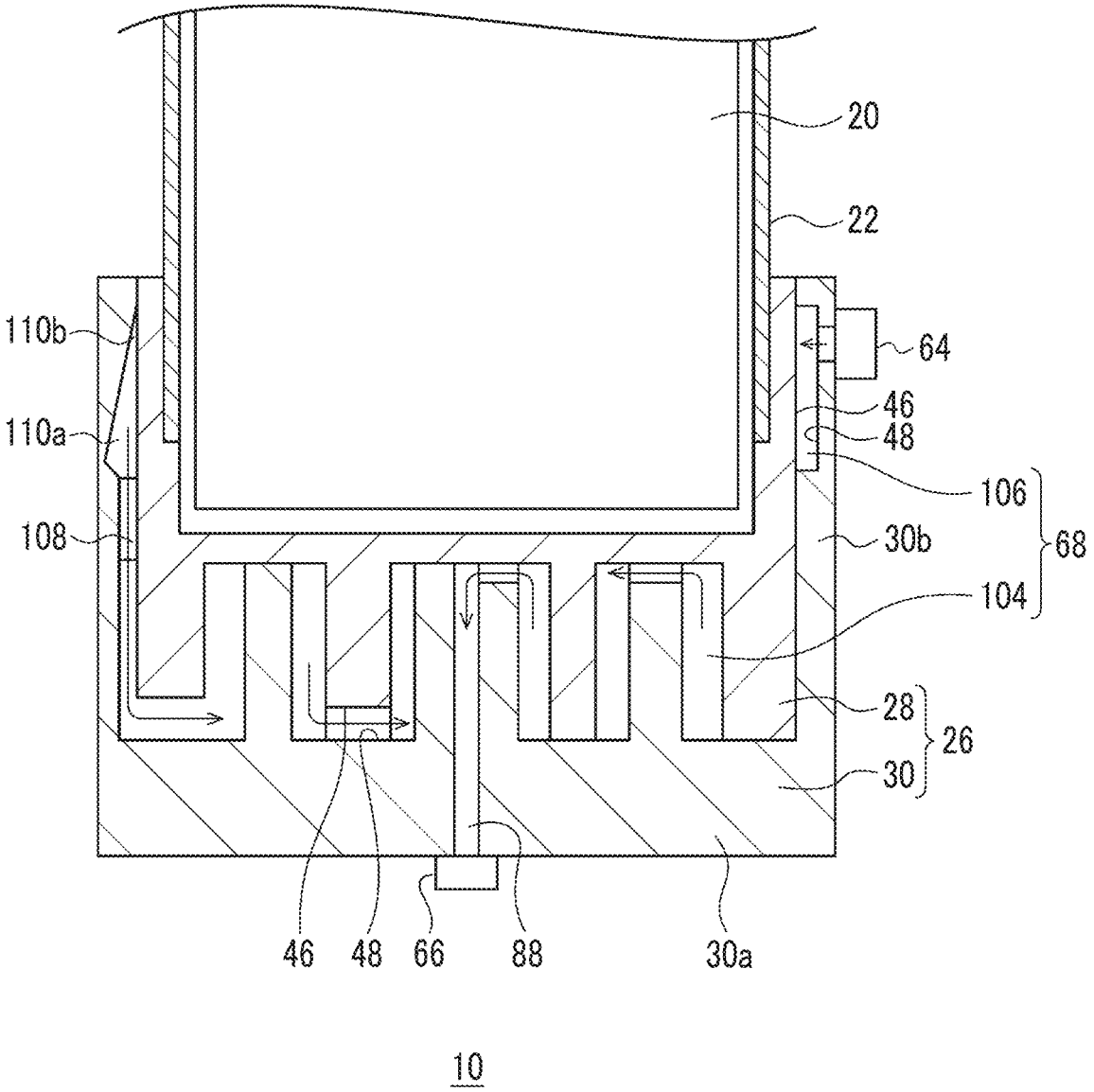
FIG. 12 is a view schematically illustrating still another example of the cryocooler according to the fourth embodiment.

FIG. 12 is a view schematically illustrating still another example of the cryocooler 10 according to the fourth embodiment. As shown in FIG. 12, the second layer 106 of the refrigerant path 68 may include an adjacent region 110*a* and a distant region 110*b*. The adjacent region 110*a* is a region close to the communication path 108 in comparison with the distant region 110*b*. The adjacent region 110*a* and the distant region 110*b* form one flow path through which the adjacent region 110*a* and the distant region 110*b* communicate with each other. The adjacent region 110*a* is positioned on the lower side in the second layer 106 in the axial direction and the distant region 110*b* is positioned on the upper side in the axial direction.

The flow path sectional area (area of section perpendicular to circumferential direction) of the adjacent region 110*a* is greater than the flow path sectional area of the distant region 110*b*. For example, the radial width of the adjacent region 110*a* may be greater than the radial width of the distant region 110*b*. In this manner, the flow path sectional area of a region where a refrigerant stream is likely to be concentrated is made relatively large. In a case as shown in FIG. 8, the flow rate of a refrigerant passing through a region in the second layer 106 that is distant from the communication path 108 and is on the upper side in the axial direction is smaller than the flow rate of a refrigerant passing through a region in the second layer 106 that is close to the communication path 108 and is on the lower side in the axial direction and as a result, heat exchange in the region that is distant from the communication path 108 and is on the upper side in the axial direction may be insufficient. According to the configuration as shown in FIG. 12, the flow path sectional area of the adjacent region 110*a* where a refrigerant stream is likely to be concentrated is relatively large. The efficiency of heat exchange between the cooling stage 26 and a refrigerant that is performed in the vicinity of the communication path 108 inside the second layer 106 may be improved.

Note that, the adjacent region 110*a* and the distant region 110*b* may be provided only in the vicinity of the communication path 108 inside the second layer 106. Alternatively, the adjacent region 110*a* and the distant region 110*b* may be provided throughout the entire second layer 106 (that is, throughout entire circumference of cooling stage 26).

Similarly, at least one layer (for example, first layer 104) of the refrigerant path 68 may include the adjacent region 110*a* and the distant region 110*b*. The efficiency of heat exchange between the cooling stage 26 and a refrigerant that is performed in the vicinity of the communication path 108 inside at least one layer (for example, first layer 104) of the refrigerant path 68 may be improved.

Hereinabove, the present invention have been described based on the examples. The present invention is not limited to the embodiments and it will be understood by those skilled in the art that various design changes can be made, various modification examples can be implemented, and the modification examples are also fall within the scope of the invention.

The shapes of the first fin 76 and the second fins 80 are not limited to ring-like shapes. The shapes of the fins may be tubular or rectangular plate-like shapes or rod-like shapes.

The refrigerant path 68 may not has a meandering shape. The first heat exchange surface 46 may not be provided with the first fin 76. The second heat exchange surface 48 may not be provided with second fins 80. At least one of the first heat exchange surface 46 and the second heat exchange surface 48 may be a flat surface. Even in this case, heat exchange between a refrigerant and the heat exchange surfaces is possible.

The various embodiments described in relation to the first embodiment can also be applied to the second to fourth embodiments. For example, the heat transfer blocks shown in FIG. 3 may be applied to the second to fourth embodiments. The configuration of the refrigerant path 68 shown in FIG. 4 may be applied to the second to fourth embodiments. The layered flow path structure in the fourth embodiment may be applied to the first to third embodiments. New embodiments resulting from combinations will provide the advantages of embodiments combined.

The above-described embodiments has been described while using the single-stage type cryocooler 10 as an example. However, the above-described embodiments also can be applied to a multi-stage type cryocooler 10. In addition, the above-described embodiments has been described while using a GM cryocooler as an example. However, the above-described embodiments can also be applied to other cryocoolers such as a sterling cryocooler and a pulse tube cryocooler.

The present invention can be utilized in the field of cryocoolers.

It should be understood that the invention is not limited to the above-described embodiment, but may be modified into various forms on the basis of the spirit of the invention. Additionally, the modifications are included in the scope of the invention.

What is claimed is:

1. A cryocooler comprising:

an expansion chamber;

a cooling stage thermally coupled to the expansion chamber, the cooling stage comprising:

a first heat transfer block provided with a surface exposed to the expansion chamber and a first heat exchange surface disposed outside the expansion chamber, and a second heat transfer block provided with a second heat exchange surface facing the first heat exchange surface;

a refrigerant supply port installed in the cooling stage outside the expansion chamber;

a refrigerant discharge port installed in the cooling stage outside the expansion chamber; and a refrigerant path fluidically separated from the expansion chamber, the refrigerant path being formed between the first heat transfer block and the second heat transfer block such that a refrigerant flows from the refrigerant supply port to the refrigerant discharge port along the first heat exchange surface and the second heat exchange surface, wherein the first heat exchange surface is provided with a first base surface and at least one first fin extending from the first base surface, the first fin being provided with a first fin tip end, wherein the second heat exchange surface is provided with a second base surface and at least one second fin extending from the second base surface along the first fin, the second fin being provided with a second fin tip end, wherein the first fin tip end is disposed closer to the second base surface than the second fin tip end and the second fin tip end is disposed closer to the first base surface than the first fin tip end, wherein the refrigerant path is provided with:

a first transverse path formed between the first fin tip end and the second base surface such that the refrigerant crosses over the first fin, a second transverse path formed between the second fin tip end and the first base surface such that the refrigerant crosses over the second fin, and an inter-fin path formed between the first fin and the second fin such that the first transverse path communicates with the second transverse path, wherein the first transverse path is locally formed between the first fin tip end and the second base surface, wherein the second transverse path is locally formed between the second fin tip end and the first base surface, and wherein arrangement of the first transverse path and the second transverse path is determined such that a refrigerant stream in the inter-fin path is guided in a direction that forms an angle with a fin height direction.

2. The cryocooler according to claim 1, further comprising:

a displacer that forms the expansion chamber between the displacer and the cooling stage, and can reciprocate in an axial direction, wherein the surface of the first heat transfer block that is exposed to the expansion chamber includes a bottom surface of the expansion chamber, the bottom surface being provided with a ring-shaped protrusion disposed to be coaxial with the displacer, the ring-shaped protrusion being hollow such that the ring-shaped protrusion accommodates the second fin from a side opposite to the bottom surface of the expansion chamber, and wherein the displacer is provided with a ring-shaped recessed portion formed to accommodate the ring-shaped protrusion.

3. The cryocooler according to claim 1, wherein the first fin has a ring-like shape centered on a center axis of the cryocooler, wherein the second fin has a ring-like shape of which a diameter is different from a diameter of the first fin, and wherein the second heat transfer block is fixed to the first heat transfer block such that a combination of the second fin and the first fin forms a concentric ring-shaped structure disposed to be coaxial with the center axis of the cryocooler.

4. The cryocooler according to claim 3, wherein the refrigerant supply port is installed in the cooling stage such that the refrigerant is supplied to an outer peripheral portion of the concentric ring-shaped structure, the refrigerant path is configured such that the refrigerant is guided to a central portion of the concentric ring-shaped structure from the outer peripheral portion of the concentric ring-shaped structure, and the refrigerant discharge port is installed in the cooling stage such that the refrigerant is discharged from the central portion of the concentric ring-shaped structure.

5. The cryocooler according to claim 3, wherein an interval between the first heat exchange surface and the second heat exchange surface at an outer peripheral portion of the concentric ring-shaped structure is smaller than an interval between the first heat exchange surface and the second heat exchange surface at a central portion of the concentric ring-shaped structure.

6. The cryocooler according to claim 1, wherein the refrigerant path is divided into a plurality of layers.

7. The cryocooler according to claim 6, wherein the plurality of layers of the refrigerant path are disposed at different places in an axial direction and are connected to each other such that the refrigerant flows therethrough sequentially.

8. The cryocooler according to claim 6, wherein the plurality of layers of the refrigerant path include a first layer and a second layer adjacent to each other in an axial direction and the refrigerant path includes a plurality of communication paths that connect the first layer and the second layer to each other.

9. The cryocooler according to claim 8, wherein flow path sectional areas of the plurality of communication paths are different from each other.

10. The cryocooler according to claim 1, wherein the refrigerant supply port is larger than the refrigerant discharge port in flow path sectional area.

* * * * *